US008781387B2

(12) United States Patent
Kobayashi

(10) Patent No.: US 8,781,387 B2
(45) Date of Patent: Jul. 15, 2014

(54) IMAGE FORMING APPARATUS

(75) Inventor: Takashi Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 1058 days.

(21) Appl. No.: 12/145,811

(22) Filed: Jun. 25, 2008

(65) Prior Publication Data

US 2009/0003910 A1 Jan. 1, 2009

(30) Foreign Application Priority Data

Jun. 26, 2007 (JP) ..... 2007-167464

(51) Int. Cl.
*G03G 15/00* (2006.01)

(52) U.S. Cl.
USPC ..... 399/400; 399/122; 399/320; 399/397

(58) Field of Classification Search
USPC ..... 399/400, 322, 122, 68, 388, 320, 317, 399/397, 324
See application file for complete search history.

(56) References Cited

U.S. PATENT DOCUMENTS 4,378,152 A * 3/1983 Edwards et al. ..... 399/322
6,970,658 B2 * 11/2005 Furukawa ..... 399/33
2006/0291915 A1 * 12/2006 Takahashi ..... 399/322

FOREIGN PATENT DOCUMENTS

JP 08-254912 A 10/1996

* cited by examiner

*Primary Examiner* — Matthew G Marini
(74) *Attorney, Agent, or Firm* — Panitch Schwarze Belisario & Nadel LLP

(57) ABSTRACT

An image forming apparatus includes a medium guide. A toner image is formed on an image bearing body. A transfer section transfers the toner image onto a print medium. A fixing section fixes the toner image into a permanent image. A guide section is disposed along a transport path in which the print medium advances toward the fixing section. The guide section includes a first portion that extends substantially parallel to the transport path, and a second portion closer to the fixing section (22) than the first portion. The second portion extends farther away from the transport path than the first portion nearer the fixing section.

32 Claims, 17 Drawing Sheets

IMAGE FORMING APPARATUS

BACKGROUND OF THE INVENTION

1. Field of the Invention

The present invention relates generally to an image forming apparatus and more particularly to a medium transporting mechanism by which a medium carrying a toner image formed thereon is transported to a fixing device.

2. Description of the Related Art

Among conventional electrophotographic image forming apparatuses that use an electrophotographic image forming process are printers, copying machines, facsimile machines and multi function printers (MFP). A transfer roller transfers a toner image onto a print medium. The print medium is then advanced to a fixing device where the toner image is fused into a permanent image.

Recent interest has arisen particularly on ecology, and therefore apparatuses capable of duplex printing are becoming dominant in the field of image forming apparatuses such as copying machines and electrophotographic printers. An image forming apparatus capable of duplex printing suffers from a problem in that a medium is prone to curve after printing on its one side. A curved medium causes poor performance in transporting the medium for printing on the non-printed side after fixing the toner image formed on one side of the medium, and leads to paper jam and paper cockle.

JP08-254912A discloses a medium transporting mechanism in which a guide is disposed between a fixing section and a transfer section and the guide abuts the leading end of a medium to correct the curved shape in the medium before the medium is fed into the fixing section.

FIG. 17 illustrates the apparatus disclosed in JP08-254912A. A medium 602 passes through a transfer point defined between a photoconductive drum 607 and a transfer roller 608. When the leading end of the medium 602 rubs a guide 601, the medium 602 vibrates. Vibration of the medium 602 may cause damage to the toner image formed on the medium 602, resulting in toner mess. Toner mess will be described with reference to FIG. 17. The toner mess on the guide 601 near a fixing roller 606 melts to become a toner solid 603 due to heat generated by a fixing section 605. The volume of the melted the toner solid 603 grows with increasing the cumulative number of printed sheets, eventually becoming an obstacle to the advancement of the medium to cause paper jam and paper cockle.

SUMMARY OF THE INVENTION

The present invention was made in view of the aforementioned drawbacks of conventional printers.

An object of the invention is to provide an image forming apparatus in which a toner image transferred onto a print medium is not damaged by a toner mess.

Another object of the invention is to provide an image forming apparatus in which a medium is smoothly advanced to a fixing section so that the medium is prevented from being jammed or cockled.

An image forming apparatus includes a medium guide. A toner image is formed on an image bearing body. A transfer section transfers the image bearing body onto a print medium. A fixing section fixes the toner image into a permanent image. A guide section is disposed along a transport path in which the print medium advances toward the fixing section. The guide section include a first portion extends substantially parallel to a direction of travel of the print medium, and a second portion contiguous with the first portion and extending farther away from the transport path than the first surface.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

Figure 1:
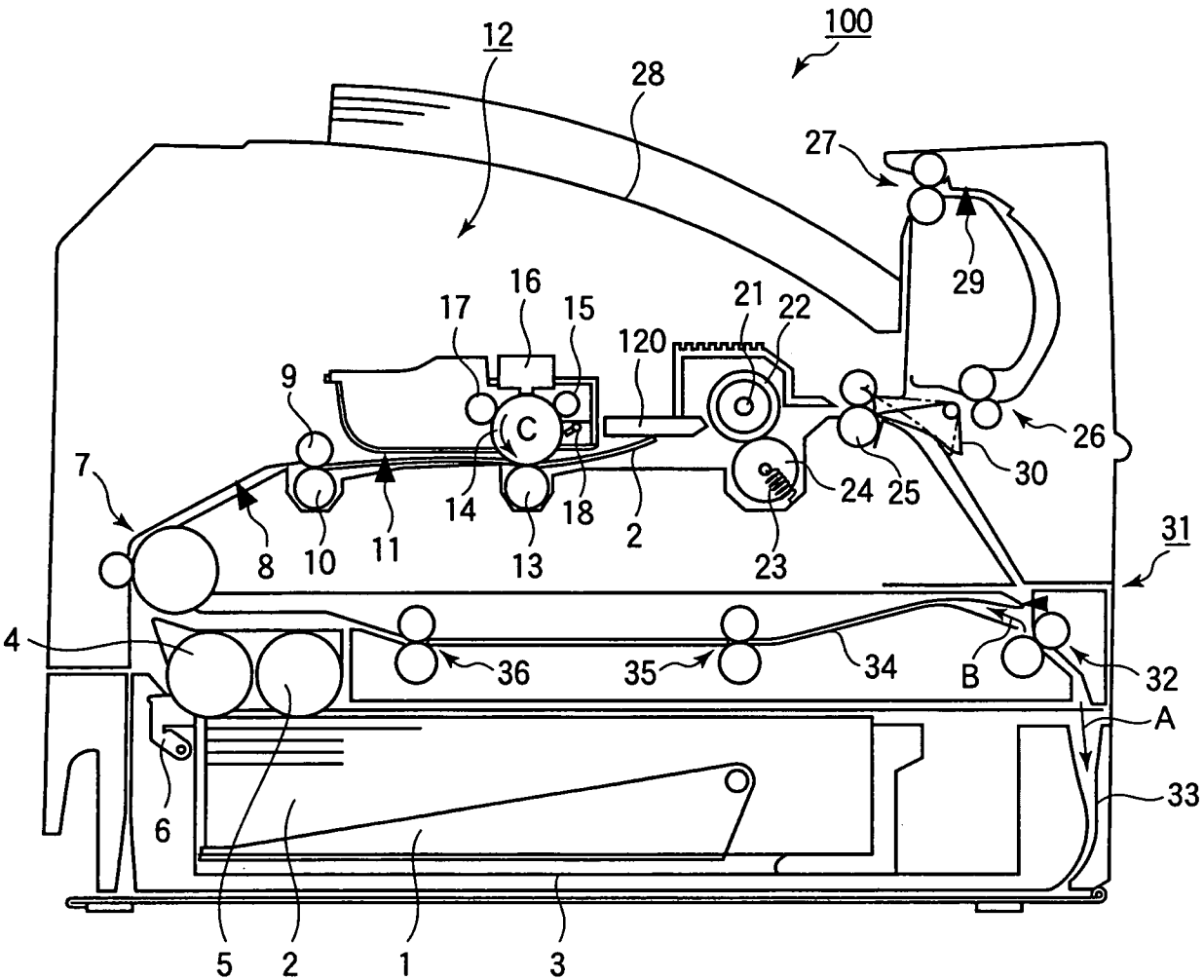
FIG. 1 illustrates a general configuration of a pertinent portion of an image forming apparatus of a first embodiment.

FIG. 1 illustrates a general configuration of a pertinent portion of an image forming apparatus 100 of a first embodiment.

Referring to FIG. 1, the image forming apparatus 100 takes the form of a printer, and includes a medium cassette 3 disposed at a lower portion of the image forming apparatus 100. The medium cassette 3 includes a platform 1 on which a stack of medium 2 is supported. A feed roller 4, a feed sub-roller 5, a separator 6 cooperate to feed the medium 2 on a sheet-by-sheet basis from the medium cassette 3 into a medium transport path. Each page of the medium 2 is transported by a transport roller 7 to a feed sensor 8. The medium 2 is detected by the feed sensor 8. The skew of the medium 2 is then corrected by a registry roller 9 and a pressure roller 10 before advancing to an image forming section 12.

A sensor 11 generates a detection signal when the sensor 11 detects the medium 2. The image forming section 12 initiates formation of a toner image in response to the detection signal. The formation of the toner image will be described later in more detail. The toner image is transferred onto the medium 2 as the medium 2 passes through a transfer point defined between a photoconductive drum 14 and a transfer section or transfer roller 13.

The image forming section 12 includes the photoconductive drum 14, a charging roller 15, an exposing head 16, a developing roller 17, and a cleaning device 18. The charging roller 15 charges the photoconductive drum 14 uniformly to a negative polarity when the photoconductive drum 14 rotates in a direction shown by arrow C. The exposing head 16 illuminates the charged surface of the photoconductive drum 14 in accordance with image data to form an electrostatic latent image. The developing roller 17 develops the electrostatic latent image with toner into a toner image. When the medium 2 passes through the transfer point, the toner image is transferred onto the medium 2. The cleaning device 18 scrapes the residual toner off the photoconductive drum 14.

A pressure roller 24 is urged against a fixing member or fixing roller 22 by a spring 23, thereby defining a fixing point between the fixing roller 22 and the pressure roller 24. The fixing roller 22 is heated by a heater 21. The medium 2 having the toner image thereon passes through the fixing point so that the toner image is fused into a permanent image by heat and pressure. The medium 2 then advances to a router 30 which is at a solid line position in a simplex printing mode, and is discharged by discharging rollers 25, 26, and 27 onto a stacker 28. A discharge sensor 29 detects the medium 2 when the medium 2 has been discharged onto the stacker 28.

A mechanism for duplex printing will be described. Assume that the router 30 is at a dotted line position.

The medium 2 having a permanent image printed on its one side is guided by the router 30 into a duplex unit 31. The medium 2 is further advanced by a transport roller 32 in a direction shown by arrow A into a transport path 33. Then, the transport roller 32 rotates in the opposite direction such that the medium 2 is advanced in a direction shown by arrow B opposite to the A direction. The medium 2 is further transported by transport rollers 35 and 36 through the duplex unit 31 to the transport roller 7 for printing on the back side of the medium 2.

Figure 2:
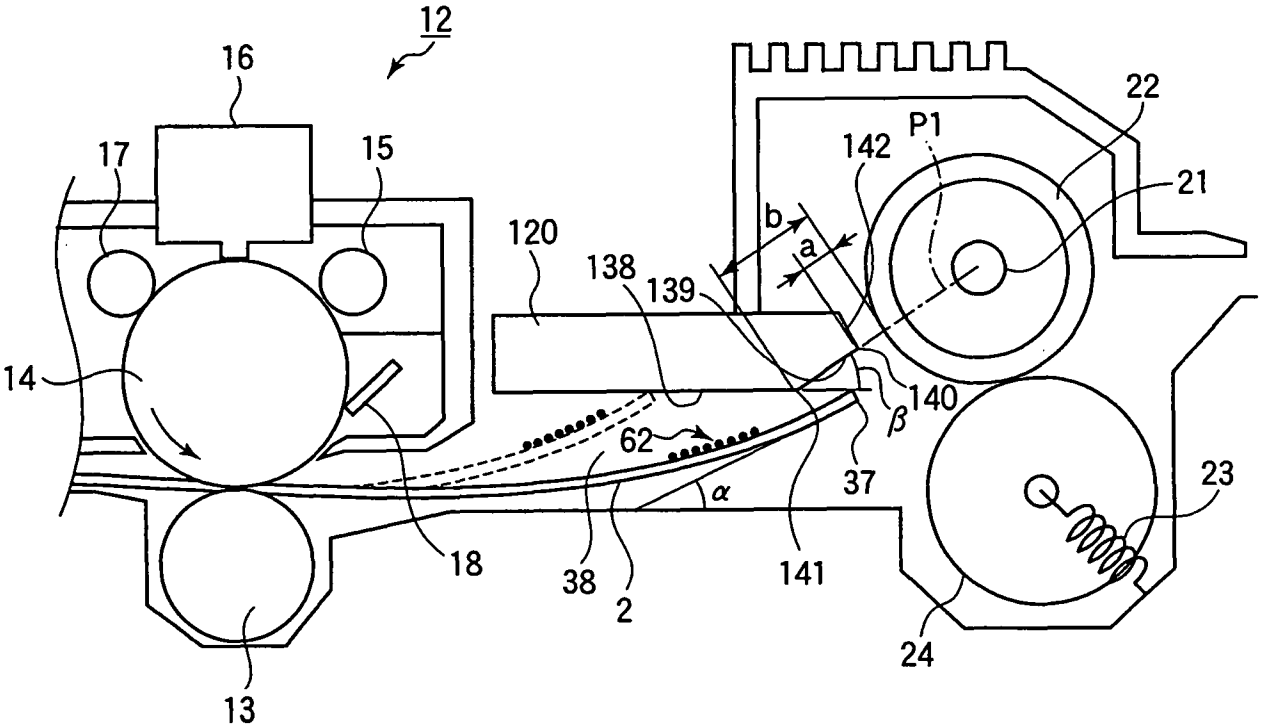
FIG. 2 is a partially expanded view of the vicinity of a transport path in which a medium advances from an image forming section to a fixing roller.

FIG. 2 is a partially expanded view of the vicinity of the transport path 38 in which the medium 2 advances from the image forming section 12 to the fixing roller 22. The construction of the image forming apparatus 100 of the embodiment will be described with reference to FIG. 2.

The medium 2 is discharged onto the stacker 28 after an image has been printed on the back side of the medium 2. A guide section or a guide 120 is disposed between the transfer point and the fixing point, extending along the transport path 38 of the medium 2 and spans across the width of the transport path 38. The guide 120 includes a guide surface 138 that lies in a substantially horizontal plane, and that guides the medium 2 having the image printed on its one side. The medium 2 has been concavely curved such that a plane tangent to the concavely curved medium 2 at a leading end 37 makes an angle $\alpha$ with a substantially horizontal plane in which the floor of the transport path 38 lies. The guide surface 138 contacts the leading end 37 of the medium 2 to reduce the curve in the medium 2 near the leading end 37. The guide 120 includes a beveled surface 139 contiguous with the guide surface 138. The beveled surface 139 includes an edge 140 close to the fixing roller 22 and an edge 141 between the beveled surface 139 and the guide surface 138. The edges 140 and 141 extend in directions substantially perpendicular to the transport path 38 in which the medium 2 travels from the image forming section 12 to the fixing point.

The beveled surface 139 extends gradually outwardly of the transport path 38 of the medium 2, lying in a plane P1 in which the edges 140 and 141 lie. The plane P1 is at an angle $\beta$ with the substantially horizontal plane in which the guide surface 138 lies. The angle $\beta$ when plane P1 passes through the rotational axis is a maximum. In other words, the angle $\beta$ may be small so that the plane P1 does not pass. The angle $\beta$ facilitates smooth advancement of the medium 2 into the fixing point defined between the fixing roller 22 and the pressure roller 24. The edge 141 is a distance b away from the surface of the fixing roller 22. The edge 140 is a distance a away from the surface of the fixing roller 22.

Figure 3:
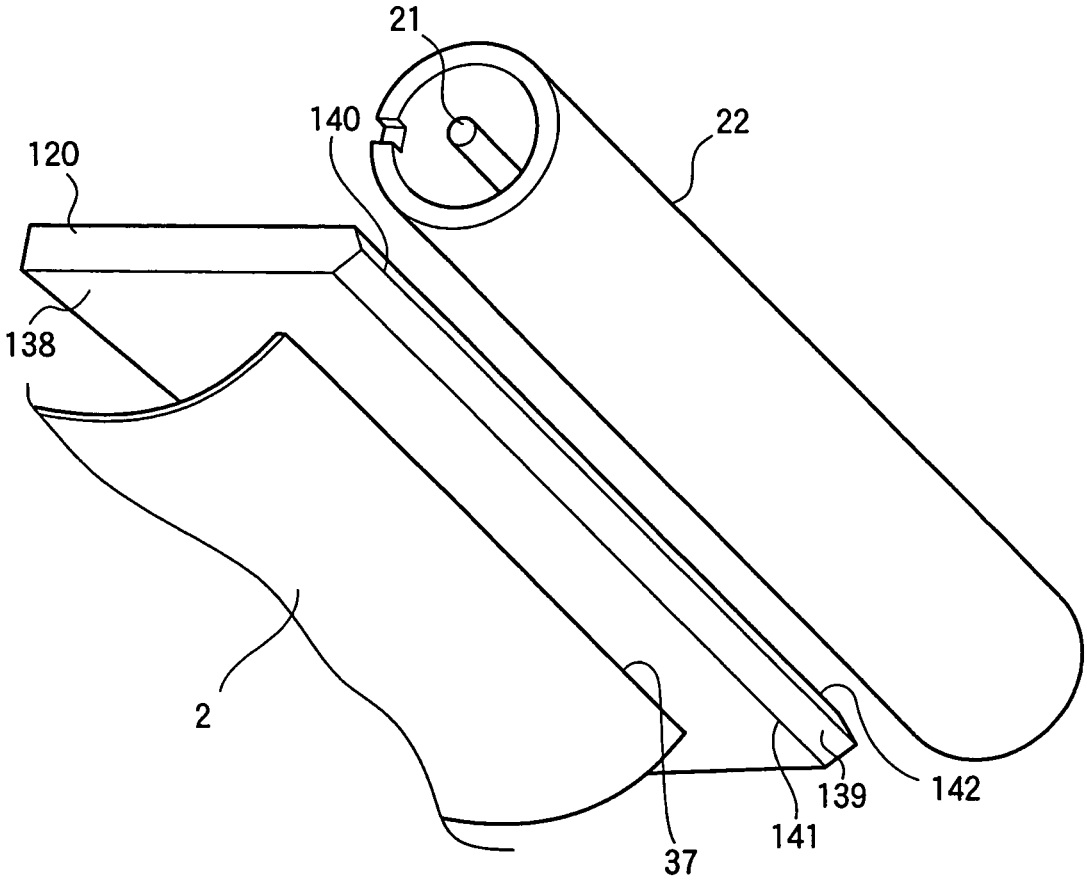
FIG. 3 is a perspective view of a pertinent portion, obliquely looking upward from the bottom of the transport path of the medium.

FIG. 3 is a perspective view of a pertinent portion, obliquely looking upward from the bottom of the transport path 38 of the medium 2. FIG. 3 illustrates the positional relation among the guide 120, medium 2, and fixing roller 22. Referring to FIG. 3, the leading end 37 of the medium 2 is in contact with the guide surface 138. The guide surface 138 is a flat, substantially horizontal surface.

A description will be given of the operation in which the medium 2 having a toner image formed thereon is guided by the guide 120.

Figure 4:
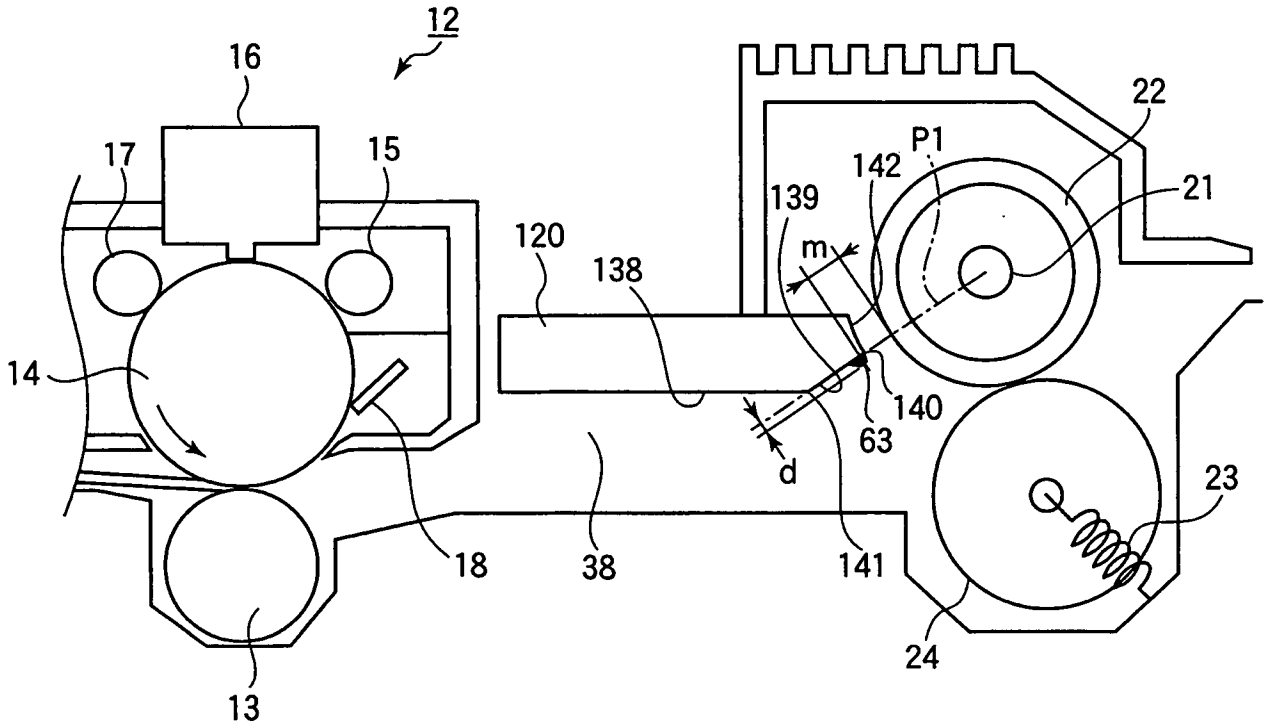
FIG. 4 illustrates a toner solid that builds up on a guide member.

FIG. 4 illustrates a toner solid that builds up on the guide 120. As shown in FIG. 2, when the concavely curved medium 2 advances toward the fixing point with its leading end 37 rubbing the guide surface 138, the medium 2 is caused to vibrate. The vibration of the medium 2 causes toner particles to fall from the medium 2, resulting in a toner mess. A large amount of the toner solid builds up on the surface 138 in the vicinity of the edge 140 closest to the fixing roller 22. The amount of the toner solid decreases with increasing distance away from the fixing roller 22. This is because the toner solid is apt to build up with increasing temperature. The temperature of the beveled surface 139 is the highest at the edge 140 and decreases nearer the edge 141. As a result, as shown in FIG. 4, the toner mess gathers on the beveled surface 139 in the vicinity of the edge 140, and melts to become caked due to heat, thereby forming a toner solid 63.

The inventors conducted an experiment to determine the temperatures of parts of the guide 120 during fixing. The guide 120 was positioned relative to the fixing roller 22 such that the distance a is a=2 mm and a distance b is b=10 mm as shown in FIGS. 2 and 3. When the surface of the fixing roller 22 was at 80° C., the edge 40 was at 60° C. and the edge 41 was 50° C.

Figure 16A:
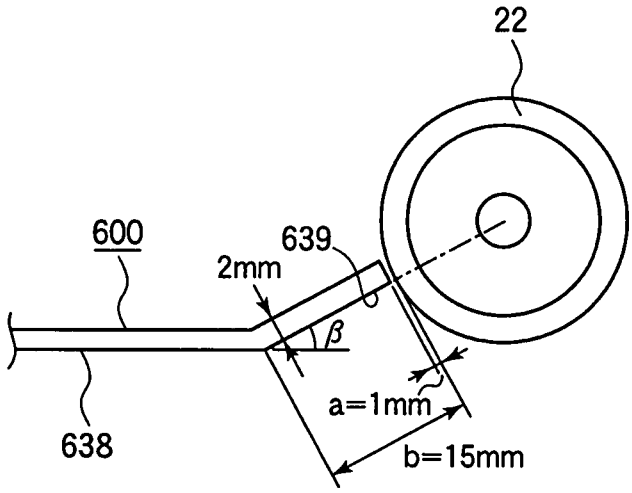
FIG. 16A illustrates the positional and dimensional relations between an experimental guide member and the fixing roller.
Figure 16B:
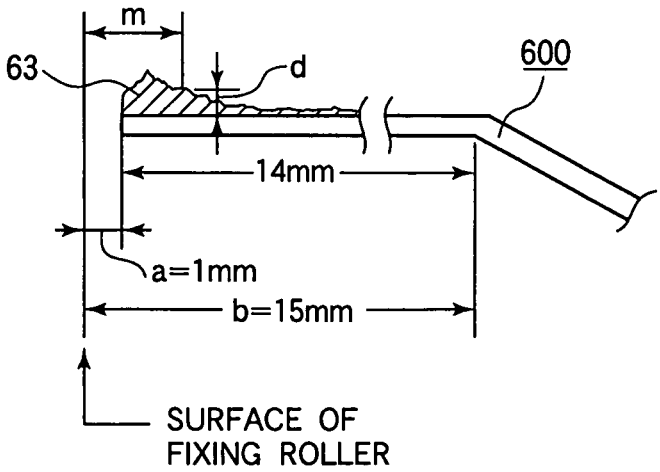
FIG. 16B illustrates the measurement of the height of the toner solid built up on the experimental guide member.
Figure 17:
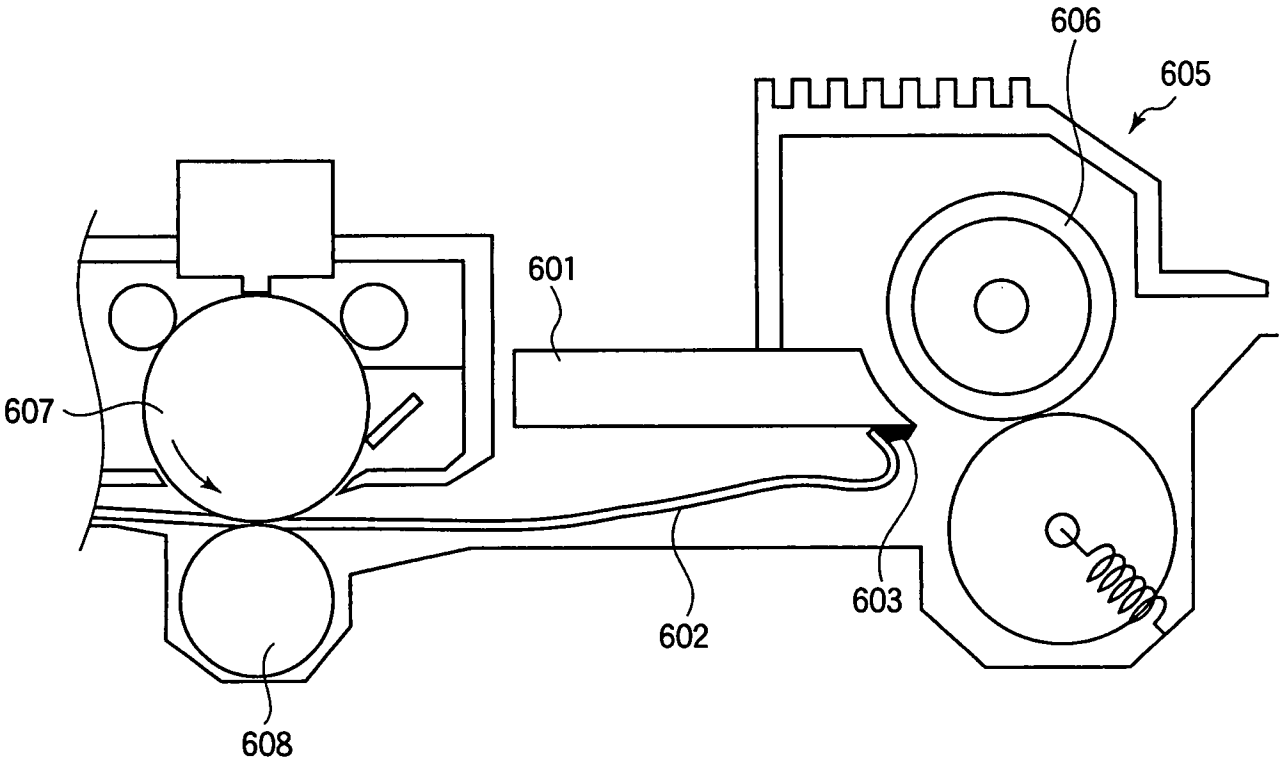
FIG.17 CONVENTIONAL ART
FIG. 17 illustrates a conventional apparatus.

FIG. 16A illustrates the positional and dimensional relations between an experimental guide member 600 and the fixing roller 22. FIG. 16B illustrates the measurement of the height of the toner solid built up on the experimental guide member 600.

The inventors also conducted another experiment to determine the thickness (or height) (FIG. 4) of a toner solid 63 at a distance m (FIG. 4) from the surface of the fixing roller 22. The simple experimental guide member 600 (FIG. 16A) was made to have a thickness of 2 mm, a guide surface 638, a beveled surface 639, and an angle β. The guide surface 638 has the same shape and size as the guide surface 138 of the guide 120 and the beveled surface 639 has the same shape and size as the beveled surface 139 of the guide 120.

The guide member 600 was installed in the image forming apparatus 100 shown in FIG. 1, being positioned relative to the fixing roller 22 such that the distance a was 1 mm and the distance b was 15 mm (FIG. 16A).

Printing was performed on 200,000 pages of print paper. After printing of 200,000 pages, the guide member 600 was detached from the image forming apparatus and was placed on a three-dimension measuring instrument. Then, the height of the toner solid 63 at the distance m from the surface of the fixing roller 22 was measured for different values of m in the range of from 1 to 15 mm in an increment of 1 mm (FIG. 16B).

TABLE 1

| DISTANCE FROM FIXING ROLLER (mm) | THICKNESS OF TONER SOLID (mm) |
|---|---|
| 1 | 0.25 |
| 2 | 0.25 |
| 3 | 0.20 |
| 4 | 0.15 |
| 5 | 0.13 |
| 6 | 0.11 |
| 7 | 0.05 |
| 8 | 0.05 |
| 9 | 0.01 |
| 10 | 0.00 |
| 11 | 0.00 |
| 12 | 0.00 |
| 13 | 0.00 |
| 14 | 0.00 |
| 15 | 0.00 |

The experimental results in Table 1 show that that the toner solid is the largest in the vicinity of the edge 140 and decreases farther away from the fixing roller 22. The beveled surface 139 should preferably be large in area. The guide 120 should be positioned a predetermined distance away from the fixing roller 22 taking into consideration mounting accuracy and dimensional accuracy of the guide 120. Thus, the guide 120 is preferably positioned such that the distance a is in the range of 2 mm≤a≤3 mm. The results shown in Table 1 also reveal that the toner solid may be formed only on the beveled surface 139 if the edge 141 is positioned such that 11 mm≤b. In other words, the distance b equal to or larger than 11 mm prevents a toner solid from building up on the guide surface 138 of the guide 120.

Figure 5:
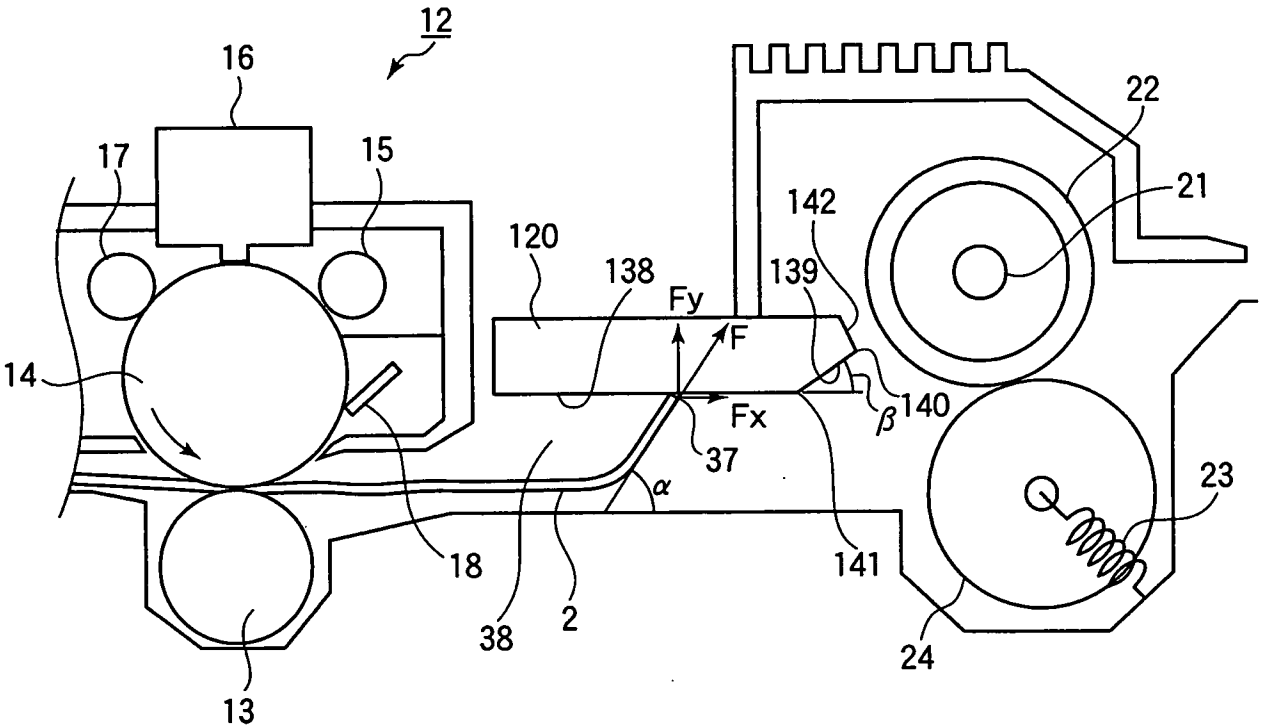
FIG. 5 illustrates the relation between an angle $\alpha$ and a force exerted on a guide surface by a leading end of the medium.

FIG. 5 illustrates the relation between the angle α and the force exerted on the guide surface 138 by the leading end 37 of the medium 2. The force exerted on the guide surface 138 by the medium 2 increases with the angle α. The force F exerted on the guide surface 138 is resolved into a component Fx in a horizontal direction and a component Fy in a vertical direction. When Fx<Fy, a vertical reaction acting on the medium 2 causes the leading end portion of the medium 2 to be seriously curved so that the medium 2 may be folded and that may not be transported normally toward the fixing point. For this reason, the angle α should be smaller than 45°. In reality, the angle α should be smaller than 30° taking into account the inwardly folding of the medium due to its own weight and an increase in the frictional force between the guide surface 138 and the leading end 37 of the medium 2.

Figure 6:
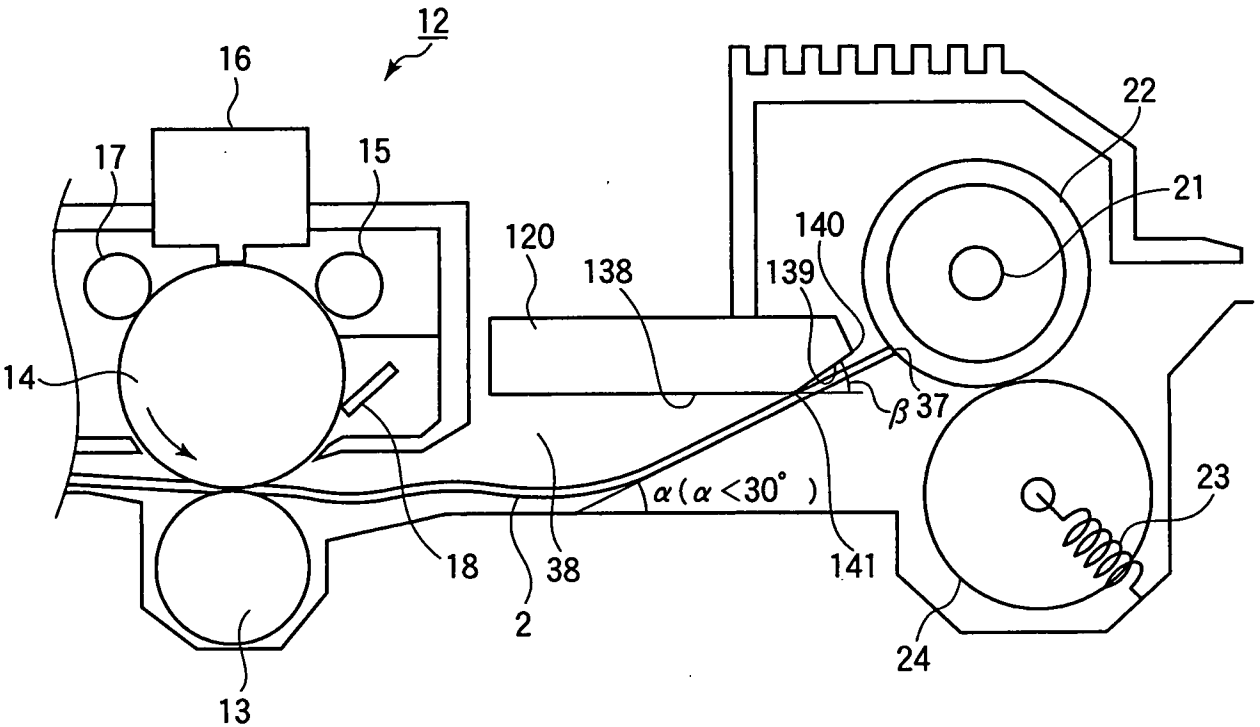
FIG. 6 illustrates the angle $\alpha$ and an angle $\beta$.

FIG. 6 illustrates the angles α and β.

Referring to FIG. 6, as long as the angle β is greater than the angle α (e.g., α<30° and β>30°), the medium 2 may be successfully guided to the fixing roller 22 without the leading end 37 contacting the beveled surface 139. Therefore, even if the toner mess concentrates in the vicinity of the edge 140 of the beveled surface 139 as shown in FIG. 4 to form the toner solid 63, the leading end 37 of the medium 2 is prevented from touching the caked toner solid 63.

As described above, when the angle α is selected such that α<30°, the angle β is selected such that β>30°. However, if the edge 140, closest to the fixing roller 22, is at a distance a in the range of 2 mm≤a≤3 mm, there is a chance of the toner solid 63 being formed in the vicinity of the edge 140. For this reason, the angle β should be selected taking into consideration the height of the toner solid 63. For example, Table 1 reveals that the maximum height of the toner solid 63 in the vicinity of the edge 140 is 0.25 mm. When the height of the toner solid 63 was 0.25, the angle β was 31.1°. Thus, the angle β equal to or larger than 32° ensures that the leading end 37 of the medium 2 does not touch the toner solid 63 formed on the surface 139 and in the vicinity of the edge 140 of the surface 139.

The guide 120 has been described as having three contiguous surfaces 138, 139, and 142 (FIG. 4). The contiguous surfaces 138 and 139 have the edge 141 at their boundary, and the contiguous surfaces 139 and 142 have the edge 140 at their boundary. The boundaries between the surfaces may be rounded to effectively eliminate the edges 140 and 141.

As described above, the guide 120 includes the guide surface 138 extending substantially in a horizontal plane and the beveled surface 139 extending at the angle β with the horizontal plane in which the guide surface 138 lies. This structure confines the toner solid 63 on the beveled surface 139 away from the guide surface 138, thereby preventing the leading end 37 of the medium 2 from interfering with the toner solid 63. This effectively prevents jam and cockle of the medium 2 when the medium 2 is being transported through the transport path 38 to the fixing point.

(Modification to First Embodiment)

Figure 7:
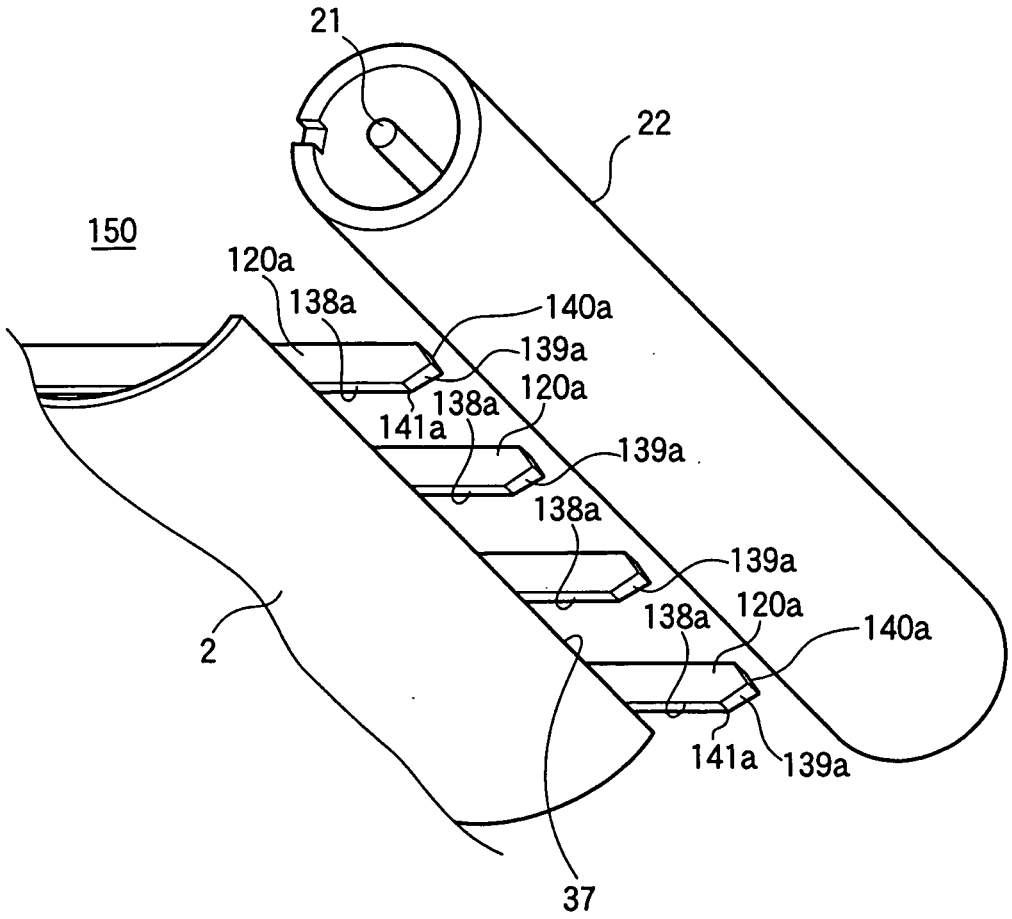
FIG. 7 illustrates a modification to the first embodiment.

The first embodiment has been described in terms of the guide 120 having the guide surface 138 which is a single flat surface. Alternatively, the guide may be configured with a plurality of guide elements that have separate surfaces lying in a substantially horizontal plane and extending in directions substantially parallel to the transport path 38 of the medium 2. FIG. 7 shows one such guide. A guide 150 includes four separate longitudinally extending guide elements 120*a*. The guide 150 is formed in one piece construction such that the guide elements 120*a* are rib-shaped elements formed on the guide 150. Alternatively, the guide elements 120*a* may be separate and independent from one another in physical separation, in which case the height of and spacing between the guide elements 120*a* should be designed so that the medium 2 contacts the guide elements only. Each of the guide elements 120*a* includes a guide surface 138*a*, a beveled guide surface 139*a*, and a surface 140*a*. Just as in the first embodiment, the beveled guide surface 139*a* lies in a plane at an angleβ with the horizontal plane in which the guide surface 138*a* lies.

Second Embodiment

Figure 8:
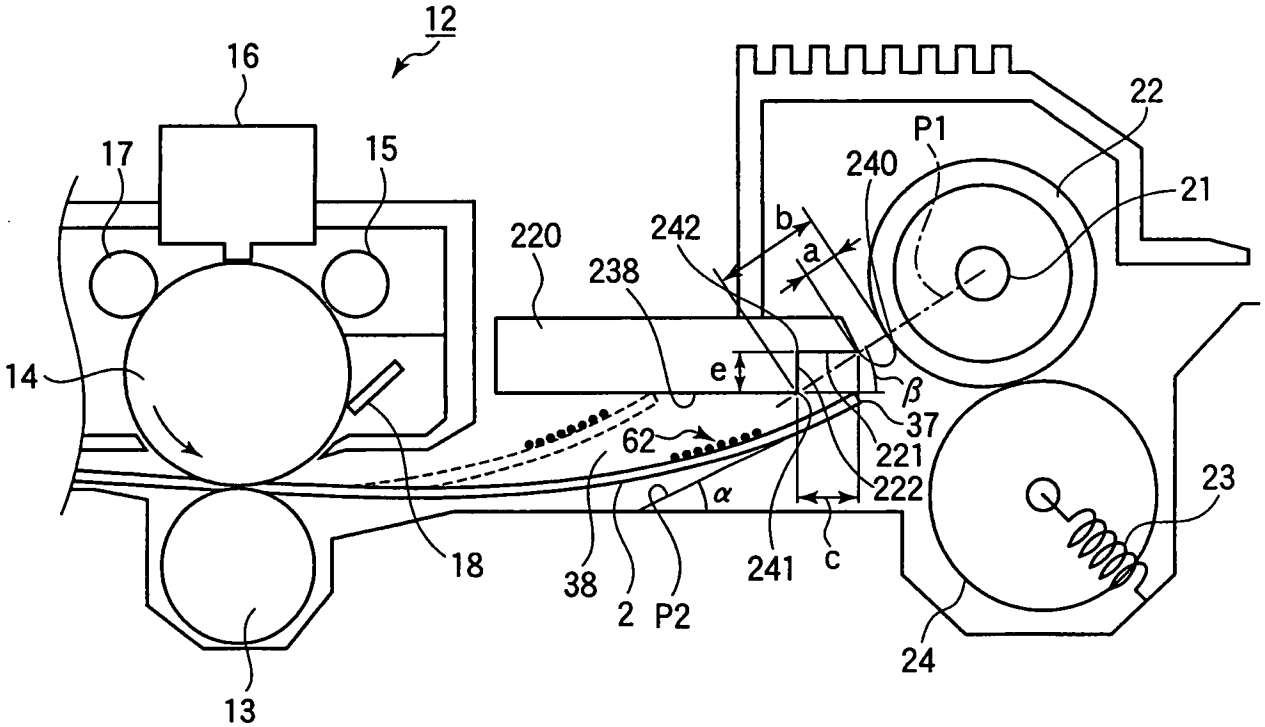
FIG. 8 is an expanded view of the vicinity of a transport path of a medium of a second embodiment, extending from the image forming section to the fixing roller.

FIG. 8 is an expanded view of the vicinity of a transport path 38 of a medium 2, extending from an image forming section 12 to a fixing roller 22.

The image forming apparatus of a second embodiment differs from that of the first embodiment in that a guide 220 is used. The guide 220 differs from the guide 120 of the first embodiment in shape. Elements similar to those of the first embodiment have been given the same reference numerals, and their description is omitted. The construction of the image forming apparatus of the second embodiment is the same as that of the first embodiment except for the guide 220. Therefore, the second embodiment will be described with reference to FIG. 1 as required.

Referring to FIG. 8, a photoconductive drum 14 cooperates with a transfer roller 13 to define a transfer point therebetween. A fixing roller 22 cooperates with a pressure roller 24 to define a fixing point therebetween. The guide 220 is disposed between the transfer point and the fixing point. The guide 220 includes a guide surface 238 and a stepped portion that is stepped outward with respect to the transport path. The stepped portion is defined by contiguous surfaces 221 and 222 substantially perpendicular to each other. The guide surface 238 and surface 221 are substantially horizontal surfaces. The surface 222 lies in a plane substantially perpendicular to the guide surface 238, and is contiguous with the guide surface 238.

Distances a, b, and e are selected such that a plane P1 (shown by dotted line) in which the edge 240 and the edge 241 lie forms an angle β with the guide surface 238, where the distance e is a distance between an edge 242 and the edge 241, the distance b is a distance in the plane P1 between the edge 241 and the surface of the fixing roller 22, and the distance a is a distance in the plane P1 between the edge 240 and the surface of the fixing roller 22. A plane P2 tangent to the concavely curved medium 2 at a leading end 37 of the medium 2 forms an angle α with the substantially horizontal floor of the transport path 38.

Figure 9:
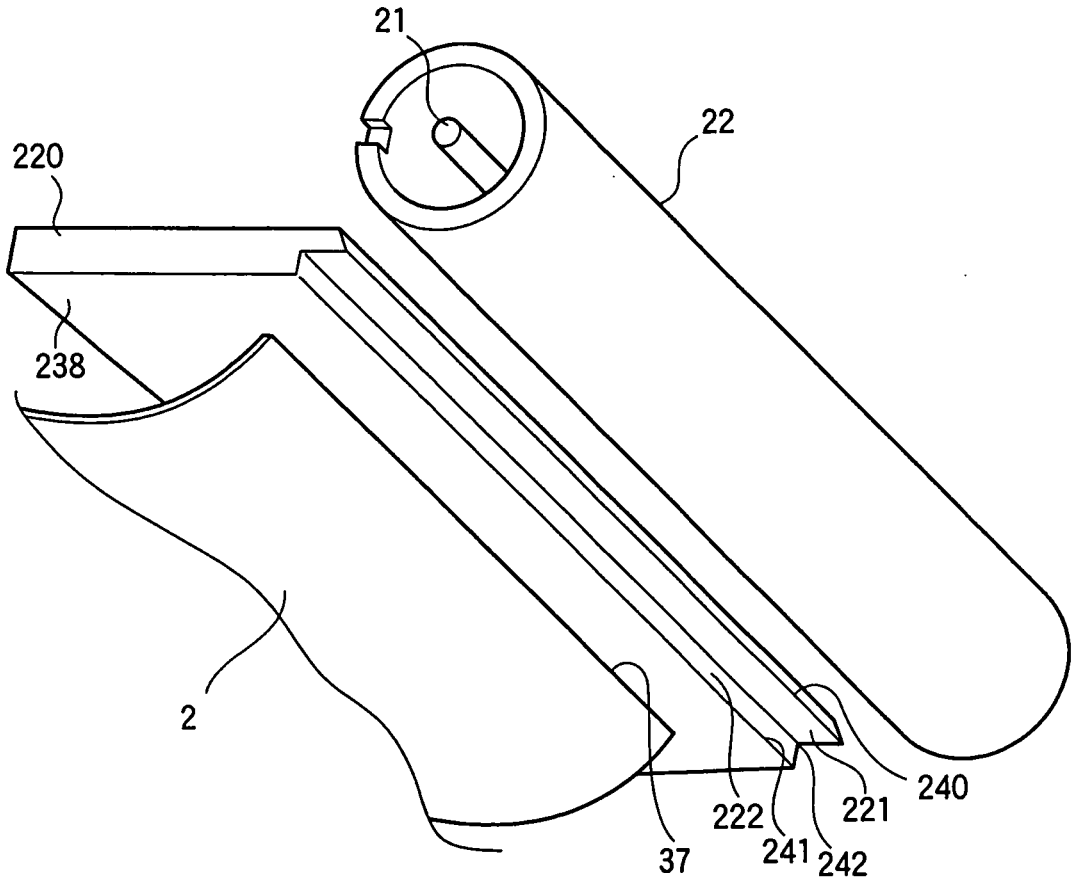
FIG. 9 is a perspective view of a pertinent portion of the apparatus obliquely looking upward from the bottom of a transport path of the medium.

FIG. 9 is a perspective view of a pertinent portion of the apparatus obliquely looking upward from the bottom of the transport path 38 of the medium 2. FIG. 9 illustrates the positional relation among the guide 220, medium 2, and fixing roller 22. Referring to FIG. 9, the guide surface 238 is a single flat, horizontal surface. The leading end 37 of the medium 2 rubs the guide surface 238 as the medium 2 advances toward the fixing point.

A description will be given of the operation in which the medium 2 having an image printed on one side permanently is guided by the guide 220 toward the fixing point while carrying a toner image on another side. Assume that the medium 2 has been concavely curved after the image printed on the one side thereof permanently.

When the concavely curved medium 2 advances to the fixing point with the leading end 37 of the medium 2 rubbing the guide surface 238, the medium 2 vibrates causing some of the toner to fall off the medium 2. This results in a toner mess. The amount of toner that adheres to the guide 120 is larger nearer the edge 240 which is the closest to the fixing roller 22 of all parts of the guide 220. This is because the toner mess is apt to become caked with increasing temperature and the temperature of the surface 221 is the highest in the vicinity of the edge 240 decreasing with increasing distance away from the edge 240.

In the first embodiment, the distances a and b are selected such that the toner mess becomes caked only on the beveled surface 139 (FIG. 2) and no toner solid builds up on the guide surface 138. In contrast, the distances a, b, and e in the second embodiment are selected such that the toner mess tends to become caked on the surfaces 221 and 222 and no toner solid builds up on the guide surface 238. The distances a, b, and e are related such that (c+e)>(b−a). Therefore, the total area of the surface 139 of the first embodiment is smaller than that of the sum of the surfaces 221 and 222 of the second embodiment.

Thus, the amount of toner per unit area that builds up on the surfaces 221 and 222 may be smaller than that formed on the beveled surface 139 (FIG. 2) of the first embodiment.

Figure 10A:
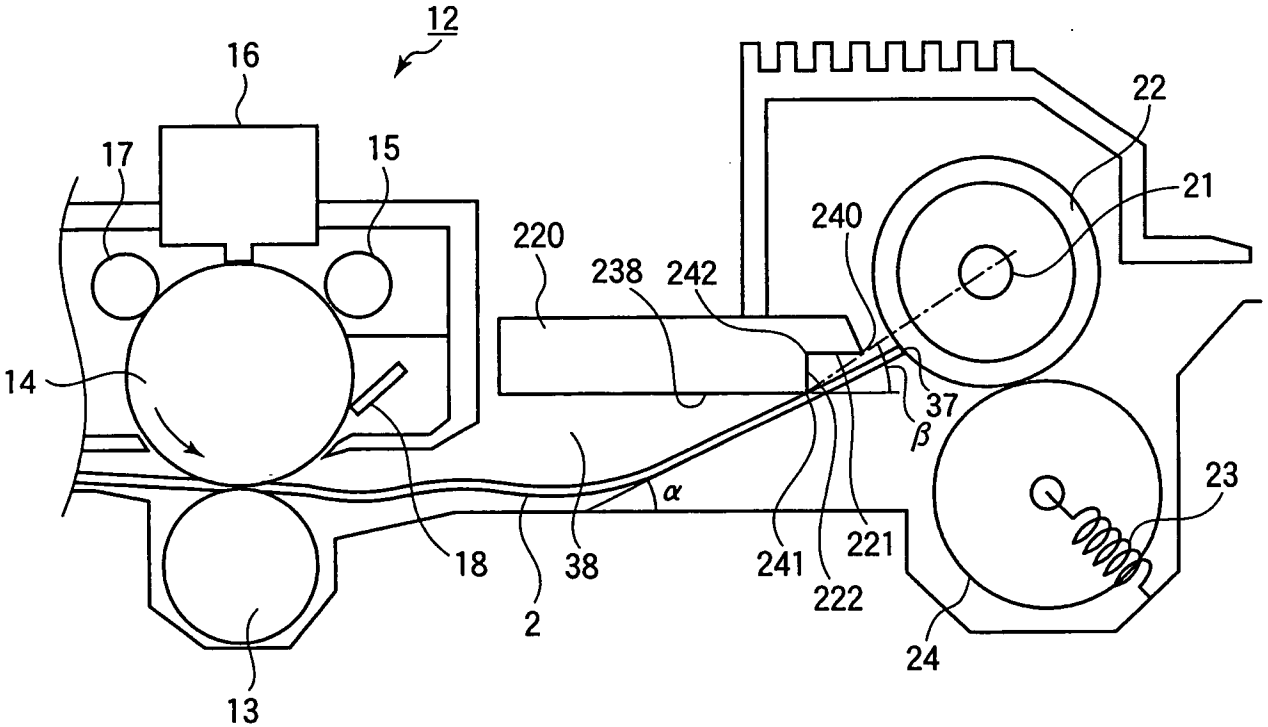
FIG. 10A illustrates the angle $\alpha$ and the angle $\beta$.
Figure 10B:
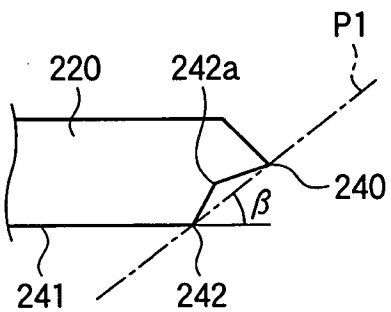
FIG. 10B illustrates a modification of the guide of the second embodiment.

FIG. 10A illustrates the angle α and the angle β. FIG. 10B illustrates a modification of the guide of the second embodiment.

Providing that α<β and the surfaces 221 and 222 are further away from the transport path 38 of the medium 2 than a plane in which the edges 240 and 241 lie, the positional relation between the surfaces 221 and 222 may be in any manner and the surfaces 221 and 222 may be of any shape (e.g., FIG. 10B) as long as the surfaces 221 and 222 are outwardly away from the plane in which the edge 240 and 241. For example, the surfaces 221 and 22 may form an obtuse angle as shown in FIG. 10B. Referring to FIG. 10A, as long as the angle β is greater than the angle α (e.g., α<30° and β>30°), the medium 2 may be successfully guided to the fixing roller 22 without the leading end 37 interfering with the surfaces 221 and 222. Therefore, even if the toner solid builds up due to heat to form a toner solid preferentially in the vicinity of the edge 240 of the surface 221, the leading end 37 of the medium 2 is prevented from interfering with the toner solid. Alternatively, the angle β may be equal to or larger than 32° just as in the first embodiment, thereby ensuring that the leading end 37 of the medium 2 does not touch the toner solid 63 formed on the surface 222 and in the vicinity of the edge 240 of the surface 221.

The angle β is selected such that β>30° just as in the first embodiment. More preferably, the angle β is greater than 32°, thereby ensuring that the leading end 37 of the medium 2 is prevented from interfering with the toner solid formed on the surfaces 221 and 222 and in the vicinity of the edge 240.

(Modification to Second Embodiment)

Figure 11:
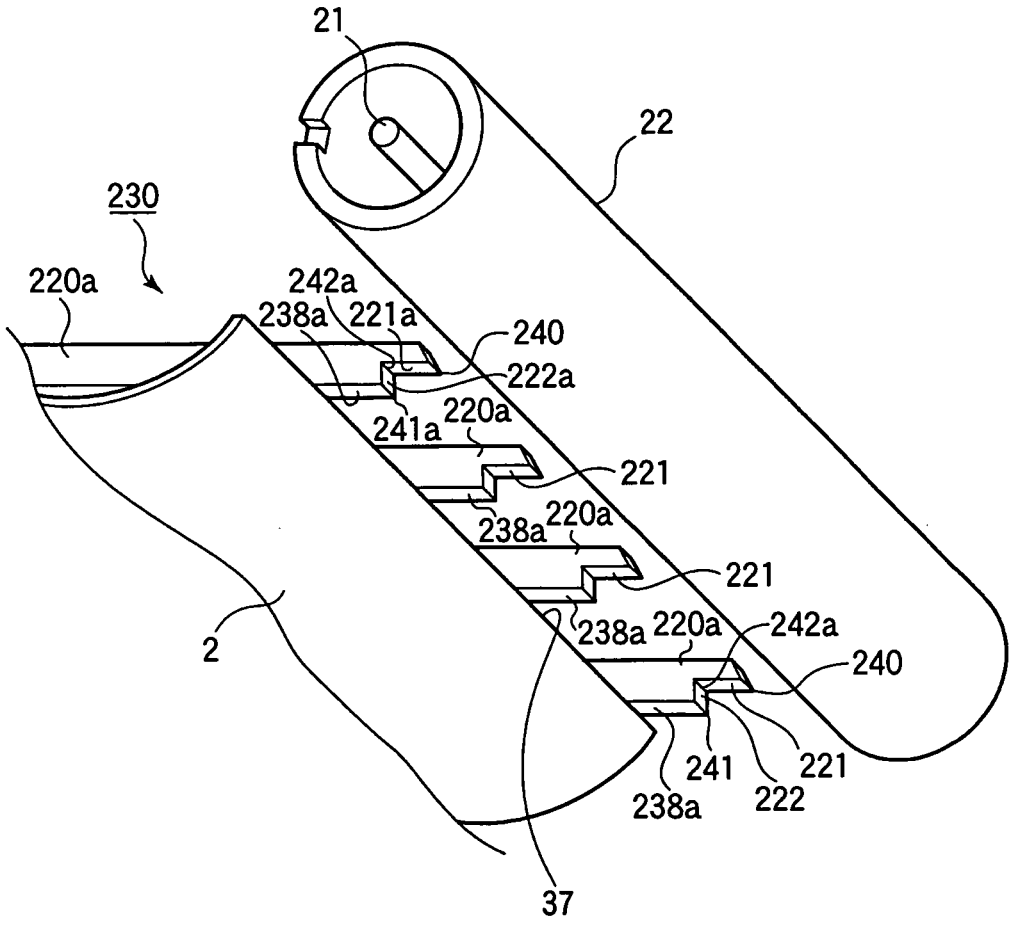
FIG. 11 illustrates a modification to the second embodiment.

While the second embodiment has been described in terms of the guide 220 having the guide surface 238 which is a single, flat surface, the guide 220 may be modified to have a plurality of separate surfaces extending in parallel in directions substantially parallel to the transport path 38 of the medium 2. FIG. 11 shows one such guide. The guide 230 includes four separate longitudinally extending guide elements 220*a*. Each of the guide elements 220*a* includes a guide surface 238*a* that lies in a substantially horizontal plane. The guide 230 shown in FIG. 11 is formed in one piece construction such that the guide elements 220*a* are rib-shaped elements formed on the guide 230. Alternatively, the guide elements 220*a* may be separate and independent from one another in physical separation, in which case the height of and spacing between the guide elements 120*a* should be designed so that the medium 2 contacts the guide elements only.

As described above, the guide 220 has been described as having three contiguous surfaces 238, 221, and 222 that meet the above-described requirements. Therefore, the structure allows the caked toner solid to be formed on the surfaces 221 and 222 rather than on the guide surface 238, thereby preventing the caked toner solid from interfering with the leading end 37 of the medium 2. Thus, when the medium 2 is transported to the fixing point, jam and cockle of the medium 2 are prevented. Further, the amount of caked toner per unit area on the surfaces 221 and 222 may be smaller than that on the beveled surface 139 (FIG. 2) of the first embodiment. Thus, a larger number of pages of medium 2 may be transported before a cake of toner-solid grows to a significant size, prolonging the usable life of the image forming apparatus.

Third Embodiment

Figure 12A:
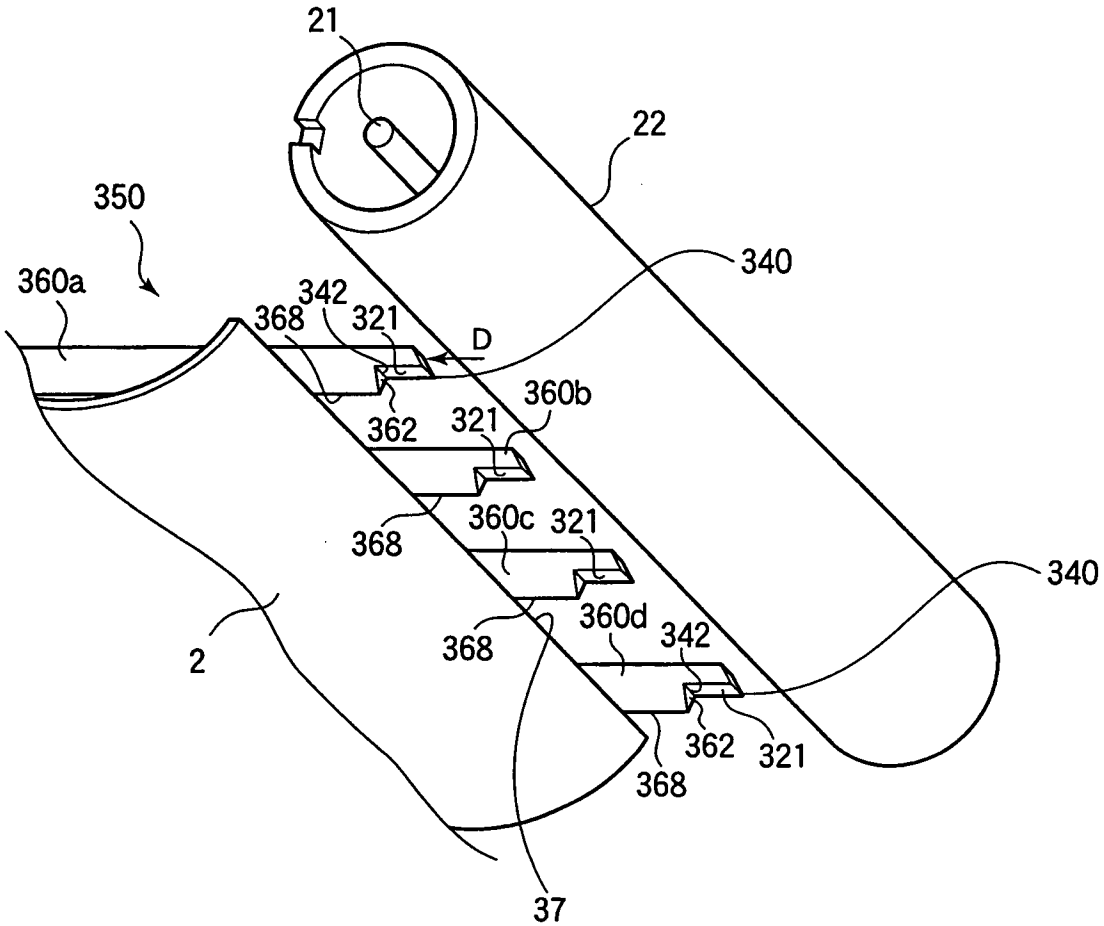
FIG. 12A is a perspective view of a pertinent portion of an image forming apparatus of a third embodiment, obliquely looking upward from the bottom of a transport path of a medium.
Figure 12B:
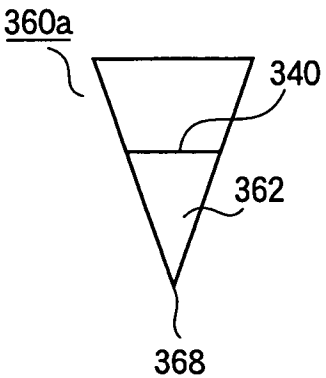
FIG. 12B is a side view of a guide of a fourth embodiment.
Figure 12C:
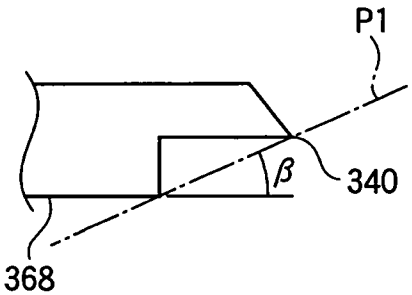
FIG. 12C illustrates a plane P1 at an angle $\beta$.

FIG. 12A is a perspective view of a pertinent portion of an image forming apparatus of a third embodiment, obliquely looking upward from the bottom of the transport path 38 of the medium 2. FIG. 12A illustrates the positional relation among a guide 350, a medium 2 guided by the guide 350, and a fixing roller 22. FIG. 12B is a side view of a guide of the fourth embodiment. FIG. 12C illustrates a plane P1 at an angle β with a plane in which the edge 368 lies, the plane P1 being a plane in which the edge 340 and the longitudinal end of the edge 368 lie.

The image forming apparatus of the third embodiment differs from that of the second embodiment in the shape of a guide. Elements common to those of the image forming apparatus 100 (FIG. 1) have been given the same reference numerals, and their description is omitted. Therefore, the apparatus will be described with reference to FIG. 1 as required.

In the modification to the second embodiment, the guide 230 includes a plurality of separate guide elements 220*a* extending in parallel in directions substantially parallel to the transport path 38 of the medium 2. Each of the guide elements 220*a* includes the guide surface 238*a*, surface 221*a*, and surface 222*a*.

In contrast, the third embodiment differs from the modification to the second embodiment in that each longitudinally extending guide element 360*a* includes a cross section of an isosceles triangle and an edge 368 that guides the medium 2. The edge 368 is defined by two contiguous surfaces. The edges 368 of the guide elements 360*a* lie in a substantially horizontal plane and extend in directions substantially parallel to the transport path 38 of the medium 2. It is to be noted that the relation between the distances a, b, and e of the second embodiment shown in FIG. 8 applies to the third embodiment, and their detailed description is omitted.

A description will be given of the operation in which the medium 2 carrying a toner image 62 (FIG. 8) thereon is guided by the guide 350 toward a fixing point.

The following are the same as those of the second embodiment, and their detailed description is omitted.

(1) When the leading end 37 of the concavely curved medium 2 rubs the edge of the guide elements 360*a*, the vibration of the medium 2 causes toner mess.

(2) The amount of caked toner per unit area on the surfaces 321 and 362 may be smaller than that on the beveled surface 39 (FIG. 2) of the first embodiment.

(3) A plane P1 in which the edges 340 and longitudinal ends of the edges 368 lie forms an angle β with a substantially horizontal plane in which the edges 368 lie.

In the second embodiment, the leading end 37 of the concavely curved medium 2 rubs the guide surface 238 of the guide 220 (FIG. 9) and the guide surface 238*a* of the guide 230 (FIG. 11). In the third embodiment, the leading end 37 of the concavely curved medium 2 rubs the edges 368 of the guide elements 360*a*. The surface area of the edges 368 is very small, causing only a limited amount of vibration of the medium 2. As a result, the amount of toner solid is also smaller than those of the first and second embodiments, so that the amount of caked toner per unit area on the surfaces 321 and 362 may be small compared to those of the first and second embodiments.

As described above, the amount of caked toner per unit area that builds up on the surfaces 321 and 362 may be smaller than those for the first and second embodiments, and has less adverse effect on the advancement of the medium 2 through the transport path 38 accordingly. Thus, a larger number of pages of medium 2 may be transported before a cake of toner-solid grows to a significant size, prolonging the usable life of the image forming apparatus.

Fourth Embodiment

Figure 13A:
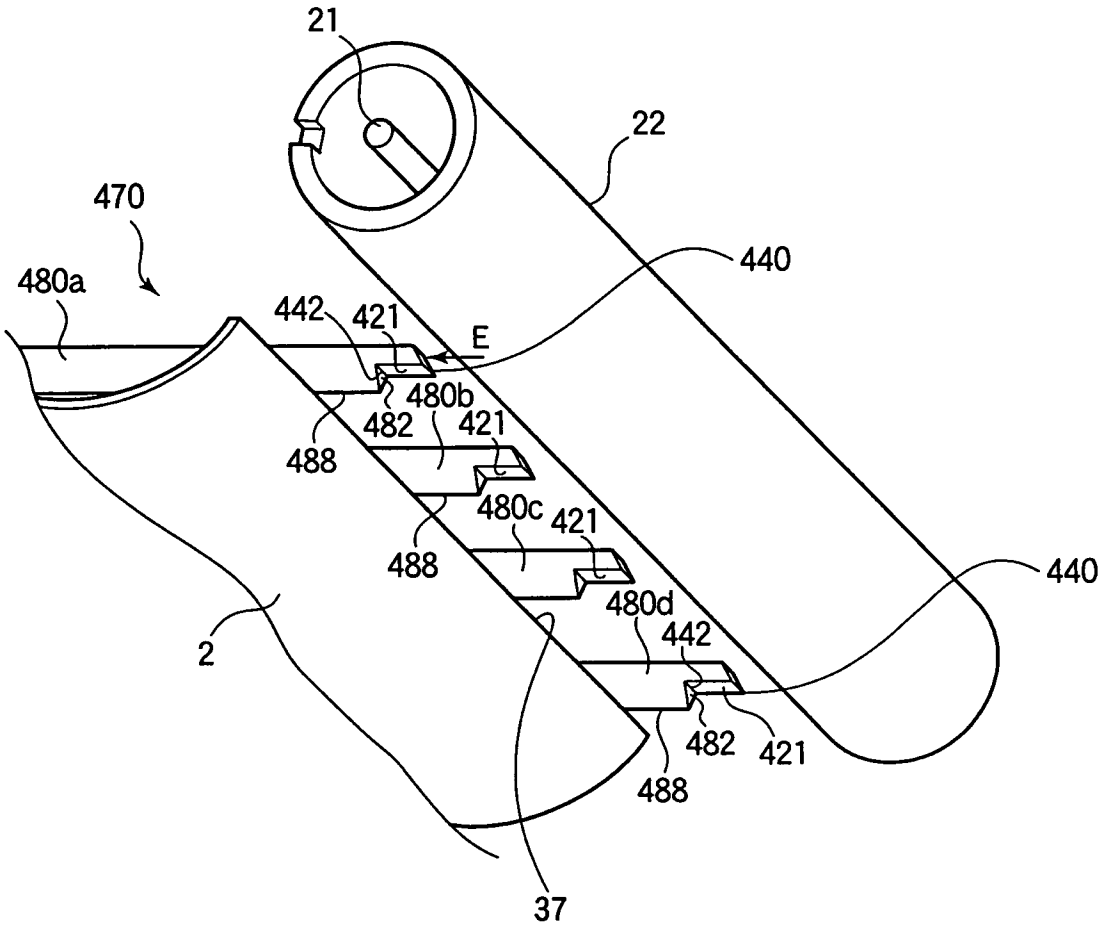
FIG. 13A is a perspective view of a pertinent portion of an image forming apparatus of the fourth embodiment, obliquely looking upward from the bottom of a transport path of a medium.
Figure 13B:
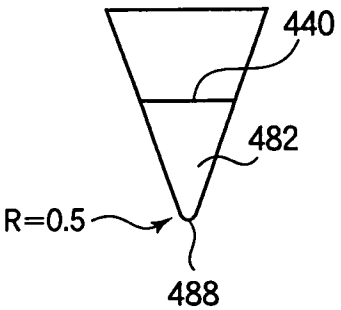
FIG. 13B is a side view of a guide of the fourth embodiment.
Figure 13C:
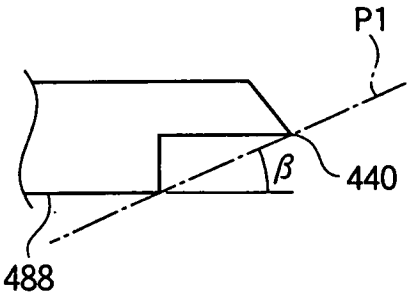
FIG. 13C illustrates a plane P1 at an angle $\beta$.

FIG. 13A is a perspective view of a pertinent portion of an image forming apparatus of a fourth embodiment, obliquely looking upward from the bottom of the transport path 38 of the medium 2. FIG. 13A illustrates the positional relation among a guide 470, a medium 2 guided by the guide 470, and a fixing roller 22. FIG. 13B is a side view of a guide of a fourth embodiment. FIG. 13C illustrates a plane P1 at an angle β with a plane in which the edge 488 lies, the plane P1 being a plane in which the edge 440 and the longitudinal end of the edge 488 lie.

The image forming apparatus of the fourth embodiment differs from that of the third embodiment only in the shape of a guide. Elements similar to those of the image forming apparatus 100 (FIG. 1) have been given the same reference numerals, and their description is omitted. Therefore, the description will be made with reference to FIG. 1 as required.

In the third embodiment, the guide 350 includes the guide elements 360*a* each of which has a cross section of an isosceles triangle (FIG. 12B). In the fourth embodiment, the guide 470 includes longitudinally extending guide elements 480*a* each of which has a cross section of a substantially isosceles triangle and a rounded edge 488 (e.g., R=0.5 mm) lying in a substantially horizontal plane parallel to the transport path 38 of the medium 2. Thus, when the concavely curved medium 2 advances toward the fixing point, the edge 37 of the medium 2 rubs the rounded surfaces 488 of the edges of the guide elements 480*a*.

A description will be given of the operation in which the medium 2 carrying a toner image 62 (FIG. 8) thereon is guided by the guide 470 toward the fixing point.

The following are the same as those of the second embodiment and their detailed description is omitted.

(1) When the leading end 37 of the concavely curved medium 2 rubs the edge 488 of the guide elements 480*a*, the vibration of the medium 2 causes toner mess.

(2) The amount of toner per unit area that builds up on the surfaces 421 and 482 may be smaller than that builds up on the beveled surface 139 (FIG. 2) of the first embodiment.

(3) A plane P1 (FIG. 13C) in which the edges 440 and longitudinal ends of the rounded edges 488 lie forms an angle β with a substantially horizontal plane in which the rounded edges 188 lie.

In the second embodiment, the leading end 37 of the concavely curved medium 2 rubs the guide surface 238 of the guide 220 (FIG. 9) or the guide surface 238*a* of the guide 230 (FIG. 11). In contrast, the leading end 37 of the concavely curved medium 2 rubs the rounded surfaces 488 of the guide elements 480*a*-480*d*. The surface area of the rounded surfaces 488 of the guide elements 480*a* is very small, causing only a limited amount of vibration of the medium 2. As a result, the amount of toner mess is also smaller than those of the second and third embodiments, so that the amount of toner per unit area that toner solids on the surfaces 421 and 482 may be small compared to the second and third embodiments.

As described above, the amount of toner solid that builds up on the surfaces 421 and 482 may be smaller than those for the second and third embodiments, and has less adverse effect on the advancement of the medium 2 through the transport path 38 accordingly. Thus, a larger number of pages of medium 2 may be transported before a cake of toner-solid grows to a significant size to interfere with the medium 2, prolonging the usable life of the image forming apparatus. The rounded surfaces 488 of the edges are smooth such that the medium 2 is not scratched or damaged when the medium 2 is guided by the rounded surfaces 488.

Fifth Embodiment

Figure 14:
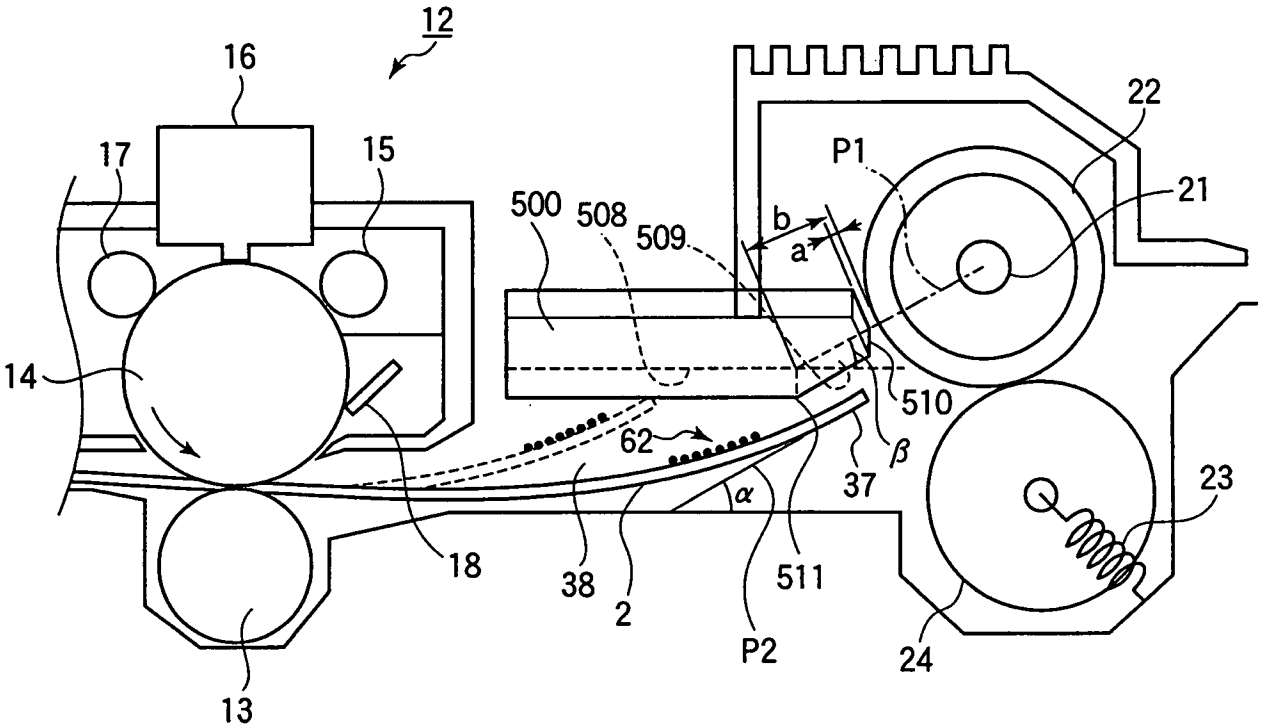
FIG. 14 is an expanded view of the vicinity of a transport path of a medium of a fifth embodiment, extending from an image forming section to a fixing roller.

FIG. 14 is an expanded view of the vicinity of a transport path 38 of a medium 2, extending from an image forming section 12 to a fixing roller 22.

The image forming apparatus of a fifth embodiment differs from the image forming apparatus 100 of the first embodiment in that a guide 500 is used. The guide 500 differs from the guide 120 of the first embodiment in shape. Elements common to those of the first embodiment have been given the same reference numerals, and their description is omitted. The construction of the image forming apparatus of the fifth embodiment is the same as that of the first embodiment except for the guide 500. Therefore, the apparatus will be described with reference to FIG. 1 as required.

A photoconductive drum 14 cooperates with a transfer roller 13 to define a transfer point therebetween. A fixing roller 22 cooperates with a pressure roller 24 to define a fixing point therebetween.

Referring to FIG. 14, the guide 500 is disposed between the transfer point and the fixing point. The guide 500 includes a guide surface 508 and a surface 509. The surface 509 is contiguous to the guide surface 508, and extends outwardly away from the transport path 38 of the medium 2. Distances a and b are selected such that a plane P1 in which the surface 509 lies forms an angle β with a curved plane in which the guide surface 508 lies, where the distance b is a distance between the surface of the fixing roller 22 and the edge 511 on the surface 509, and the distance a is a distance between the edge 510 and the surface of the fixing roller 22 in the plane P1. A plane P2 tangent to the concavely curved medium 2 at a leading end 37 forms an angle α with a substantially horizontal floor of the transport path 38.

Figure 15:
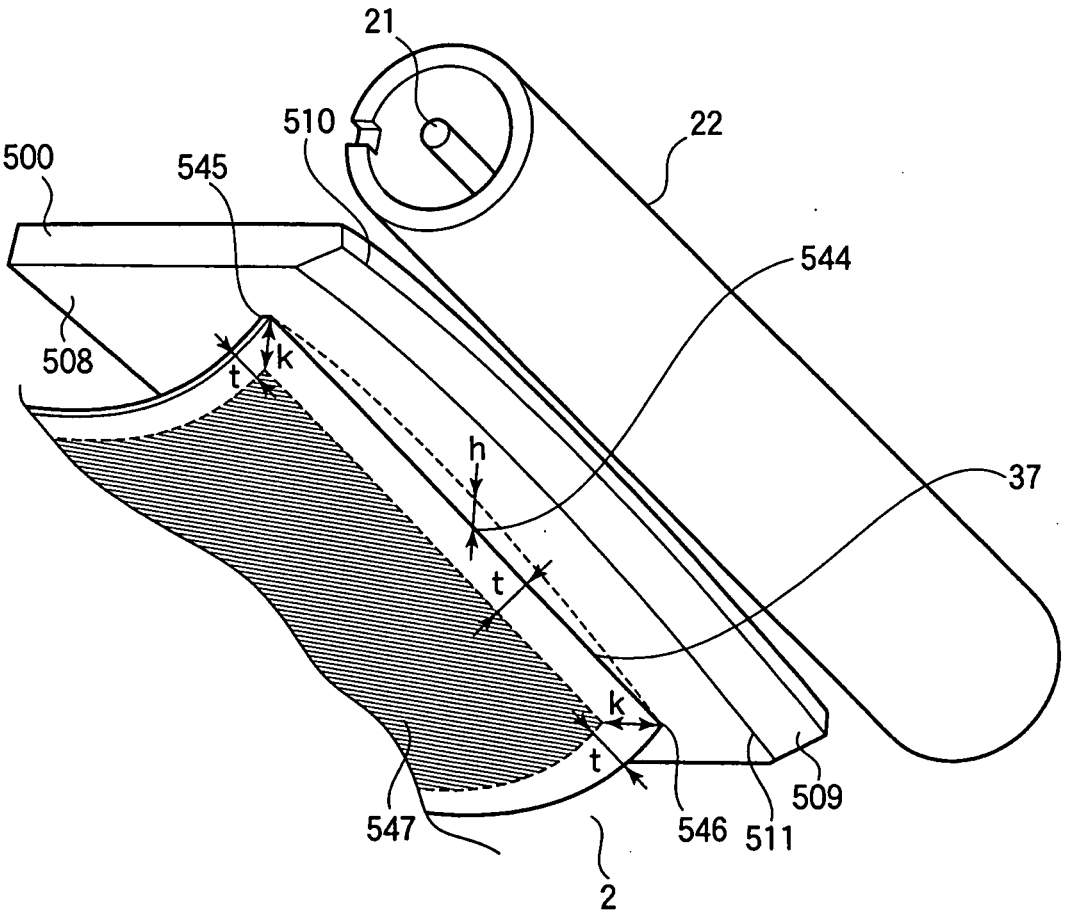
FIG. 15 is a perspective view of a pertinent portion, obliquely looking upward from the bottom of a transport path of the medium.

FIG. 15 is a perspective view of a pertinent portion, obliquely looking upward from the floor of the transport path 38 of the medium 2. FIG. 15 illustrates the positional relation among the guide 500, medium 2, and fixing roller 22. Referring to FIG. 15, the guide surface 508 and surface 509 are contiguous and curved surfaces. The guide surface 508 lies in an arcuate plane such that the guide surface 508 is curved about the transport path 38 with a radius of curvature of about 100 mm. The surface 508 is disposed to extend straight along and over the substantially horizontal floor of the transport path 38.

A description will be given of the operation during duplex printing in which the concavely curved medium 2 carrying a toner image on one side thereof is guided by the guide 500 after a permanent image has been formed on another side thereof.

The following are the same as those of the first embodiment and their detailed description is omitted.

(1) When the concavely curved medium 2 advances to the fixing point with the leading end 37 of the medium 2 rubbing the guide surface 508, the medium 2 vibrates causing toner particles to fall off the medium 2. This results in a toner mess.

(2) The amount of toner solid that builds up on the guide 500 is larger nearer the edge 510.

(3) The amount of toner solids decreases with increasing distance away from the edge 510 which is the closest to the fixing roller 22. This is because the ambient temperature is the highest in the vicinity of the edge 510 and decreases with increasing distance away from the edge 510.

In the first embodiment, the toner solid builds up only on the beveled surface 139 (FIG. 2), and the distances a and b are selected such that no toner solid builds up on the guide surface 538. In the fifth embodiment, the distances a and b are selected in the same manner as in the first embodiment such that the toner solid builds up only on the surface 509 and no toner solid builds up on the guide surface 508. The angles α and β are related such that $\alpha<\beta$.

Referring to FIG. 15, because the guide surface 508 is curved about the transport path 38, there is a gap h between the medium 2 and the guide surface 508. The gap h is a maximum at the middle of the medium 2 in a direction perpendicular to the transport path 38 in which the medium 2 advances to the fixing unit, and decreases nearer the widthwise ends 545 and 546 of the medium 2. The medium 2 contacts the guide 500 at the widthwise ends 545 and 546 (i.e., corners of the medium 2). A toner image 547 is in an area located a distance t away from the lateral edges and longitudinal edges of the medium 2. The shortest distance k between the toner image 547 and the widthwise ends 545 and 546 is longer than the distance t. Thus, the toner image 547 in the laterally middle of the leading end 37 is a distance h+t away from the guide surface 508, and the toner image 547 at the widthwise ends 545 and 546 is a distance k away from the guide surface 508.

As described above, the vibration of the medium 2 may be minimized because only a limited portion of the medium 2 having a very small area touches the guide surface 508. The distance k (where $k>t$) may be large, being effective in preventing transmission of the vibration of the medium 2 to the toner image 547 on the medium 2. Thus, the amount of toner mess may be minimized and the amount of toner solid per unit area that builds up on the surface 509 may be minimized.

As described above, the amount of toner solid that builds up on the surface 508 may be smaller than that for the first embodiment, and has less adverse effect on the advancement of the medium through the transport path 38 accordingly. Thus, a larger number of pages of medium 2 may be transported before a cake of toner-solid grows to a significant size, prolonging the usable life of the image forming apparatus.

The present invention has been described with respect to an image forming apparatus having a printer function, the invention is not limited to a printer. The invention may be applied to apparatuses such as facsimile machines, copying machines, and multi functional peripherals (MFP).

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus, comprising:

an image bearing body on which a toner image is formed;

a transfer section that transfers the toner image onto a print medium;

a fixing section including a fixing member that fuses the toner image on the print medium; and a guide section including a first portion and a second portion and disposed generally along a transport direction in which the print medium advances toward the fixing section with an un-fused toner image directly facing the first portion and the second portion, wherein the first portion extends substantially parallel to a direction of travel of the print medium, and the second portion is located downstream of the first portion with respect to the direction of travel of the print medium, the second portion including an upstream end that is contiguous with the first portion and a downstream end on a side of the second portion opposite the upstream end, the upstream end and the downstream end lying in a plane that extends toward the fixing member and farther away from the direction of travel of the print medium nearer the fixing member, the second portion including one of a first surface that lies in the plane and a second surface that lies farther away from a surface of the print medium on which the un-fused toner image is carried than the plane.

2. The image forming apparatus according to claim 1, wherein the second portion extends over a distance of at least 11 mm from a surface of the fixing section.

3. The image forming apparatus according to claim 2, wherein the second portion is a single surface that lies in a flat plane.

4. The image forming apparatus according to claim 3, wherein the second portion is a stepped portion formed in the guide section.

5. The image forming apparatus according to claim 1, wherein the second portion has a surface that lies in a plane at an acute angle with a direction in which the first portion extends.

6. The image forming apparatus according to claim 5, wherein the second portion is a surface that lies in a plane at an angle larger than 30 degrees with a direction in which the first portion extends.

7. The image forming apparatus according to claim 6, wherein the angle is equal to or larger than 32 degrees.

8. The image forming apparatus according to claim 7, wherein the second portion includes a plurality of surfaces.

9. The image forming apparatus according to claim 7, wherein the plurality of surfaces define a stepped portion formed in the guide section.

10. The image forming apparatus according to claim 1, wherein the guide section extends in a direction substantially perpendicular to a direction of travel of the print medium so that the guide section spans at least across a width of the print medium.

11. The image forming apparatus according to claim 1, wherein the first portion is a flat surface.

12. The image forming apparatus according to claim 1, wherein the first portion lies in a plane curved about the transport path and extends straight in a direction of travel of the print medium.

13. The image forming apparatus according to claim 1, wherein the guide section extends in a direction substantially perpendicular to a direction of travel of the print medium so that the guide section spans at least across a range in which the fixing section fuses the toner image.

14. The image forming apparatus according to claim 1, wherein the guide section includes a plurality of guide elements aligned in a direction substantially perpendicular to a direction of travel of the print medium, and extending in directions substantially parallel to the direction of travel of the print medium.

15. The image forming apparatus according to claim 14, wherein each of the plurality of guide elements includes the first portion, the first portion being a flat surface that extends in a direction of travel of the print medium.

16. The image forming apparatus according to claim 15, wherein each of the plurality of guide elements includes the first portion, the first portion being a substantially line-shaped edge, and that extends in a direction of travel of the print medium.

17. The image forming apparatus according to claim 15, wherein each of the plurality of guide elements includes the first portion, the first portion being a rounded surface that is defined between two surfaces, and that extends in a direction of travel of the print medium.

18. The image forming apparatus according to claim 1, wherein the second portion lies in a major side of a plane opposite the transport path, the plane extending such that at least a part of the first portion and at least a part of the second portion lie in the plane, the plane extending toward the fixing section to form an acute angle with a direction in which the first portion extends.

19. The image forming apparatus according to claim 18, wherein the second portion is a surface that lies in a plane at an angle larger than 30 degrees with a direction in which the first portion extends.

20. An image forming apparatus, comprising:

an image bearing body on which a toner image is formed;

a transfer section that transfers the toner image onto a print medium;

a fixing section including a fixing member that fuses the toner image on the print medium; and a guide section disposed upstream of the fixing section and including a first portion and a second portion that is contiguous with the first portion, the guide section guiding the print medium toward the fixing section with an un-fused toner image directly facing the first portion and the second portion, wherein the first portion extends substantially parallel to a direction of travel of the print medium, wherein the second portion is located downstream of the first portion with respect to the direction of travel of the print medium, and includes a surface that extends in a direction farther away from a surface of the print medium on which the un-fused toner image is carried nearer the fixing member.

21. The image forming apparatus according to claim 20, wherein the surface is farther away from the transport path than the first portion nearer the fixing section.

22. The image forming apparatus according to claim 20, wherein the second portion extends over a distance of at least 11 mm from a surface of the fixing section.

23. The image forming apparatus according to claim 22, wherein the second portion is a single surface that lies in a flat plane.

24. The image forming apparatus according to claim 20, wherein the second portion is a surface that lies in a plane at an angle larger than 30 degrees with a direction in which the first portion extends.

25. The image forming apparatus according to claim 24, wherein the angle is equal to or larger than 32 degrees.

26. The image forming apparatus according to claim 20, wherein the guide section extends in a direction substantially perpendicular to a direction of travel of the print medium so that the guide section spans at least across a width of the print medium.

27. The image forming apparatus according to claim 20, wherein the first portion is a flat surface.

28. The image forming apparatus according to claim 20, wherein the guide section extends in a direction substantially perpendicular to a direction of travel of the print medium so that the guide section spans at least across a range in which the fixing section fuses the toner image.

29. The image forming apparatus according to claim 20, wherein the second portion lies in a major side of a plane opposite the transport path, the plane extending such that at least a part of the first portion and at least a part of the second portion lie in the plane, the plane extending toward the fixing section to form an acute angle with a direction in which the first portion extends.

30. The image forming apparatus according to claim 20, wherein the second portion is a surface that lies in a plane at an angle larger than 30 degrees with a direction in which the first portion extends.

31. The image forming apparatus according to claim 20, wherein the surface is farther away from the transport path than the first portion nearer the fixing section.

32. The image forming apparatus according to claim 20, wherein the guide section includes a third portion contiguous with the downstream end of the second portion, the third portion including a surface that lies in a plane that forms an obtuse angle with a direction in which the first portion extends.

* * * * *